US010087751B2

(12) United States Patent
Stokely

(10) Patent No.: US 10,087,751 B2
(45) Date of Patent: Oct. 2, 2018

(54) SUBSURFACE FIBER OPTIC STIMULATION-FLOW METER

(71) Applicant: HALLIBURTON ENERGY SERVICES, INC., Houston, TX (US)

(72) Inventor: Christopher Lee Stokely, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/898,330

(22) PCT Filed: Aug. 20, 2013

(86) PCT No.: PCT/US2013/055713
§ 371 (c)(1),
(2) Date: Dec. 14, 2015

(87) PCT Pub. No.: WO2015/026324
PCT Pub. Date: Feb. 26, 2015

(65) Prior Publication Data
US 2016/0138389 A1 May 19, 2016

(51) Int. Cl.
*E21B 47/12* (2012.01)
*E21B 47/14* (2006.01)
*E21B 47/10* (2012.01)

(52) U.S. Cl.
CPC ..... *E21B 47/123* (2013.01); *E21B 47/101* (2013.01); *E21B 47/14* (2013.01)

(58) Field of Classification Search
None
See application file for complete search history.

(56) References Cited

U.S. PATENT DOCUMENTS

| | | | | |
|---|---|---|---|---|
| 3,834,227 | A | 9/1974 | Patterson et al. | |
| 4,183,243 | A | 1/1980 | Patterson et al. | |
| 4,347,747 | A | 9/1982 | Srinivasan | |
| 6,351,987 | B1 | 3/2002 | Winston et al. | |
| 6,354,147 | B1 | 3/2002 | Gysling et al. | |
| 6,782,150 | B2 | 8/2004 | Davis et al. | |
| 6,785,004 | B2 | 8/2004 | Kersey et al. | |
| 7,281,415 | B2 | 10/2007 | Johansen | |
| 7,401,530 | B2 | 7/2008 | Johansen | |
| 7,665,543 | B2 * | 2/2010 | Bostick, III | E21B 21/08 175/45 |

(Continued)

FOREIGN PATENT DOCUMENTS

WO 2010136773 12/2010

OTHER PUBLICATIONS

Alford et al., "Development and Field Evaluation of the Production Surveillance Monitor", Journal of Petroleum Technology, SPE 6095, Feb. 1978, 7 pages.

(Continued)

*Primary Examiner* — Leon-Viet Nguyen
(74) *Attorney, Agent, or Firm* — Kilpatrick Townsend & Stockton LLP

(57) ABSTRACT

A system is provided that includes a fiber optic cable and a fiber optic interrogator. The fiber optic cable contains acoustical sensors that can be positioned in stimulation fluid in a wellbore. The fiber optic interrogator can determine flow rate of the stimulation fluid based on signals from the fiber optic cable.

20 Claims, 8 Drawing Sheets

(56) References Cited

U.S. PATENT DOCUMENTS

| | | | | |
|---|---|---|---|---|
| 7,880,133 | B2 | 2/2011 | Johansen | |
| 7,881,884 | B2 | 2/2011 | Perry et al. | |
| 7,938,023 | B2 | 5/2011 | Johansen et al. | |
| 8,347,958 | B2 | 1/2013 | Hartog et al. | |
| 2001/0023614 | A1 | 9/2001 | Tubel et al. | |
| 2002/0113718 | A1* | 8/2002 | Wei | E21B 47/12 340/855.3 |
| 2005/0012036 | A1 | 1/2005 | Tubel et al. | |
| 2005/0046859 | A1* | 3/2005 | Waagaard | G01B 11/18 356/478 |
| 2005/0125170 | A1 | 6/2005 | Gysling et al. | |
| 2007/0047867 | A1 | 3/2007 | Goldner | |
| 2009/0200079 | A1 | 8/2009 | Zaeper et al. | |
| 2010/0038079 | A1* | 2/2010 | Greenaway | E21B 47/0007 166/254.2 |
| 2011/0139447 | A1 | 6/2011 | Ramos et al. | |
| 2011/0292763 | A1* | 12/2011 | Coates | E21B 47/01 367/25 |
| 2012/0152024 | A1 | 6/2012 | Johansen | |
| 2012/0205103 | A1* | 8/2012 | Ravi | E21B 33/14 166/285 |
| 2012/0222487 | A1 | 9/2012 | Hill et al. | |
| 2013/0021615 | A1 | 1/2013 | Duncan et al. | |
| 2013/0061688 | A1 | 3/2013 | Hayward et al. | |
| 2013/0113629 | A1* | 5/2013 | Hartog | G01V 1/226 340/853.2 |
| 2013/0336612 | A1* | 12/2013 | Pearce | E21B 47/011 385/12 |
| 2015/0014521 | A1* | 1/2015 | Barfoot | E21B 47/123 250/261 |
| 2015/0034306 | A1* | 2/2015 | Hull | E21B 47/04 166/250.01 |
| 2015/0135819 | A1* | 5/2015 | Petrella | G01V 1/40 73/152.58 |
| 2016/0138386 | A1 | 5/2016 | Stokely et al. | |
| 2017/0322133 | A1* | 11/2017 | Trainer | G01N 15/0205 |

OTHER PUBLICATIONS

Bakewell et al., "Wall Pressure Correlations in Turbulent Pipe Flow", U.S. Navy Underwater Sound Laboratory Report No. 559, Aug. 1962, pp. 1-62.

Clinch , "Measurements of the Wall Pressure Field at the Surface of a Smooth-Walled Pipe Containing Turbulent Water Flow", Journal of Sound Vibrations, vol. 9, No. 3, 1969, pp. 398-419.

Daniels et al., "Wall Pressure Fluctuations in Turbulent Pipe Flow", Technical Report TR 86-006, retrieved from http://www.dtic.mil/dtic/tr/fulltext/u2/a173359.pdf, Sep. 1986, 118 pages.

De Jong , "Analysis of Pulsations and Vibrations in Fluid-Filled Pipe Systems", Doctoral Thesis, Eindhoven University of Technology, retrieved from http://alexandria.tue.nl/repository/books/423649.pdf, 1994, 170 pages.

Gysling et al., "Sonar-Based, Clamp-On Flow Meter for Gas and Liquid Applications", ISA Expo, BI0036 Rev. B., 2003, 12 pages.

Johannessen et al., "Distributed Acoustic Sensing—A New Way of Listening to Your Well/Reservoir", SPE 149602, 2012, 9 pages.

Jost et al., "A Student's Guide to and Review of Moment Tensors", Seismological Research Letters, vol. 60, No. 2, Apr.-Jun., 1989, pp. 37-57.

Kang et al., "Prediction of Wall-Pressure Fluctuation in Turbulent Flows with an Immersed Boundary Method", Journal of Computational Physics, vol. 228, 2009, pp. 6753-6772.

Keith et al., "Wavenumber-Frequency Analysis of Turbulent Wall Pressure Fluctuation over a Wide Reynolds Number Range of Turbulent Pipe Flows", Sensors and Sonar Systems Department, Naval Undersea Warfare Center, Newport, Rhode Island, Oceans 2011 Conference, Sep. 2011, 5 pages.

Kersey et al., "Fiber-Optic Systems for Reservoir Monitoring", World Oil, vol. 10, Oct. 1999, pp. 91-97.

Kragas et al., "Downhole Fiber-Optic Multiphase Flowmeter: Design, Operating Principle, and Testing", SPE Annual Technical Conference and Exhibition, San Antonio, Texas, Sep. 29-Oct. 2, 2002, pp. 1-7.

Lauchle et al., "Wall-Pressure Fluctuations in Turbulent Pipe Flow", Physics of Fluids, vol. 30, 1987, pp. 3019-3024.

Maestrello , "Measurement and Analysis of the Response Field of Turbulent Boundary Layer Excited Panels", Journal of Sound Vibrations, vol. 2, No. 3, 1965, pp. 270-292.

Patterson , "A FLowline Monitor for Production Surveillance", SPE 5769, 1976, 8 pages.

International Patent Application No. PCT/US2013/055713, International Search Report and Written Opinion, dated May 14, 2014, 14 pages.

Unalmis et al., "Evolution in Optical Downhole Multiphase Flow Measurement: Experience Translates into Enhanced Design", SPE 126741, 2010, 17 pages.

U.S. Appl. No. 14/900,752, Non-Final Office Action, dated Nov. 3, 2017, 10 pages.

* cited by examiner

SUBSURFACE FIBER OPTIC STIMULATION-FLOW METER

CROSS-REFERENCE TO RELATED APPLICATIONS

This is a U.S. national phase under 35 U.S.C. § 371 of International Patent Application No. PCT/US2013/055713, titled "Subsurface Fiber Optic Stimulation-Flow Meter" and filed Aug. 20, 2013, the entirety of which is incorporated herein by reference.

TECHNICAL FIELD

The present disclosure relates generally to fiber optic sensor systems for use in and with a wellbore and, more particularly (although not necessarily exclusively), to monitoring the flow rate of fluid during a well stimulation operation using fiber optic acoustic sensing.

BACKGROUND

Hydrocarbons can be produced from wellbores drilled from the surface through a variety of producing and non-producing formations. The formation can be fractured, or otherwise stimulated, to facilitate hydrocarbon production. A stimulation operation often involves high flow rates and the presence of a proppant. Monitoring flow rates during a stimulation process can be a technical challenge. Quantitatively monitoring in a downhole wellbore environment can be particularly challenging.

DETAILED DESCRIPTION

Figure 1:
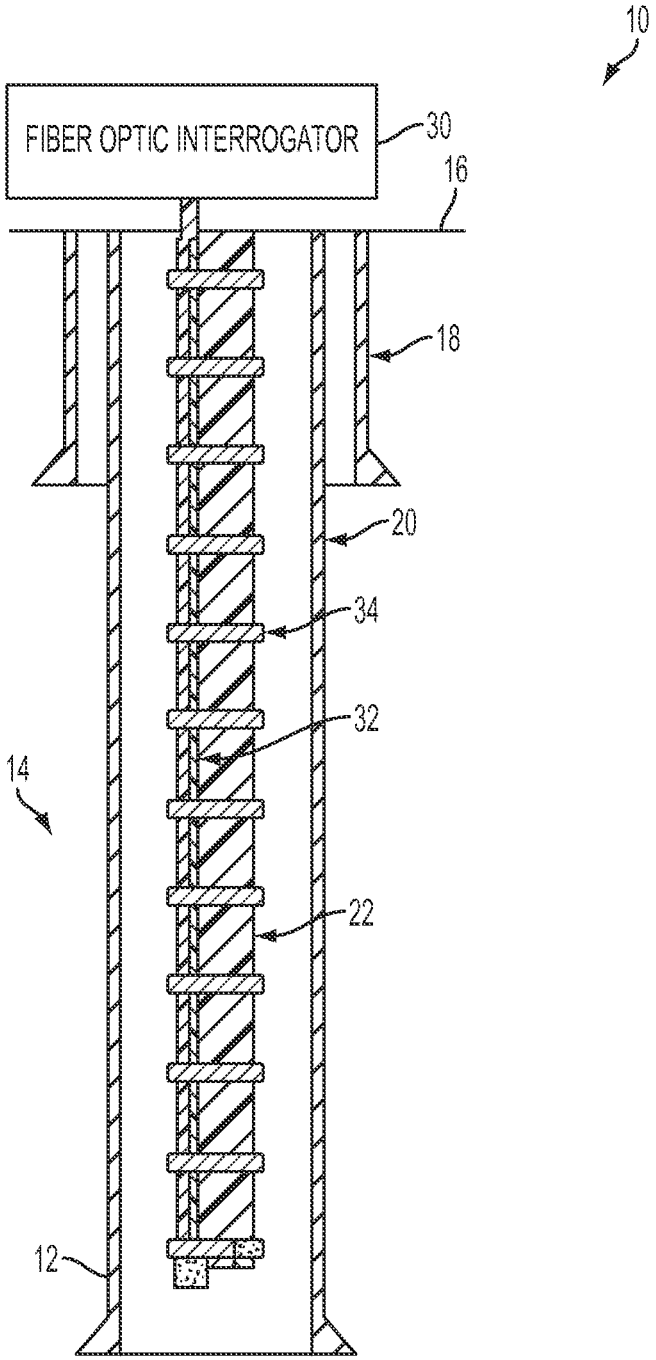
FIG. 1 is a cross-sectional schematic view of a wellbore that includes a fiber optic acoustic sensing subsystem according to one aspect.

Certain aspects and features relate to monitoring flow rates in a wellbore during downhole stimulation operations using a fiber optic acoustic sensing system. Fiber optic sensors deployed in a wellbore can withstand wellbore conditions during stimulation operations. A fiber optic cable with sensors can be deployed in the wellbore to measure temperature, strains, and acoustics (with high spatial resolution or otherwise) at one or many locations in the wellbore. In some aspects, the fiber optic cable itself is a sensor. Electronics, such as a fiber optic interrogator, at a surface of the wellbore can analyze sensed data and determine parameters about downhole conductions, including downhole fluid flow rate during a stimulation operation.

Acoustics can be relevant for monitoring or measuring flow rates. Acoustic monitoring locations can be at discreet point locations, or distributed at locations along a fiber optic cable. Fiber Bragg gratings may be used as point sensors that can be multiplexed in a distributed acoustic sensing system and can allow for acoustic detection at periodic locations on the fiber optic cable. For example, sensors may be located every meter along a fiber optic cable in the wellbore, which may result in thousands of acoustical measurement locations. In other aspects, the distributed acoustic sensing system can include a fiber optic cable that continuously measures acoustical energy along spatially separated portions of the fiber optic cable.

The dynamic pressure of flow in a pipe can result in small pressure fluctuations related to the dynamic pressure that can be monitored using the fiber optic acoustic sensing system. These fluctuations may occur at frequencies audible to the human ear. The dynamic pressure may be many orders of magnitude less than the static pressure. The dynamic pressure is related to the fluid velocity in a pipe through $\Delta p = K \cdot \rho \cdot \bar{u}^2$, where K is a proportionality constant, $\rho$ is fluid density, and $\bar{u}$ is average bulk flow velocity. The dynamic pressure $\Delta p$ can be estimated by measuring pressure fluctuations or acoustic vibrations. The mean of $\Delta p$ can be zero, while the root-mean-square of the pressure fluctuations may not be zero. The root mean square of an acoustic signal can be related to a flow rate in a pipe. Since the fluid density and the surface flow rate forced downhole can be known during stimulation operations, the flow rate at locations in the wellbore can be measured using acoustic sensing with fiber optic cables deployed along the well at different angular locations on the pipe. The proportionality constant K can be dependent on the type of fluid and mechanical features of the well, which can be determined through a calibration procedure. Mechanical coupling of the two fiber optic sections to the pipe may be identical or characterized through a calibration procedure that can also resolve mechanical characteristics of the pipe, such as bulk modulus and ability to vibrate in the surrounding formation or cement.

Fiber optic acoustic sensing system according to some aspects can be used to monitor flow rates at particular zones or perforations. Monitoring flow rates and determining flow rates at particular zones or perforations can allow operators to intelligently optimize well completions and remedy well construction issues.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts an example of a wellbore system 10 that includes a fiber optic acoustic sensing subsystem according to one aspect. The system 10 includes a wellbore 12 that penetrates a subterranean formation 14 for the purpose of recovering hydrocarbons, storing hydrocarbons, disposing of carbon dioxide (which may be referred to as a carbon dioxide sequestration), or the like. The wellbore 12 may be drilled into the subterranean formation 14 using any suitable drilling technique. While shown as extending vertically from the surface 16 in FIG. 1, in other examples the wellbore 12 may be deviated, horizontal, or curved over at least some portions of the wellbore 12. The wellbore 12 includes a surface casing 18, a production casing 20, and tubing 22. The wellbore 12 may be, also or alternatively, open hole and may include a hole in the ground having a variety of shapes or geometries.

The tubing 22 extends from the surface 16 in an inner area defined by production casing 20. The tubing 22 may be production tubing through which hydrocarbons or other fluid can enter and be produced. In other aspects, the tubing 22 is another type of tubing. The tubing 22 may be part of a subsea system that transfers fluid or otherwise from an ocean surface platform to the wellhead on the sea floor.

Some items that may be included in the wellbore system 10 have been omitted for simplification. For example, the wellbore system 10 may include a servicing rig, such as a drilling rig, a completion rig, a workover rig, other mast structure, or a combination of these. In some aspects, the servicing rig may include a derrick with a rig floor. Piers extending downwards to a seabed in some implementations may support the servicing rig. Alternatively, the servicing rig may be supported by columns sitting on hulls or pontoons (or both) that are ballasted below the water surface, which may be referred to as a semi-submersible platform or rig. In an off-shore location, a casing may extend from the servicing rig to exclude sea water and contain drilling fluid returns. Other mechanical mechanisms that are not shown may control the run-in and withdrawal of a workstring in the wellbore 12. Examples of these other mechanical mechanisms include a draw works coupled to a hoisting apparatus, a slickline unit or a wireline unit including a winching apparatus, another servicing vehicle, and a coiled tubing unit.

The wellbore system 10 includes a fiber optic acoustic sensing subsystem that can detect acoustics or other vibrations in the wellbore 12 during a stimulation operation. The fiber optic acoustic sensing subsystem includes a fiber optic interrogator 30 and one or more fiber optic cables 32, which can be or include sensors located at different zones of the wellbore 12 that are defined by packers (not shown). The fiber optic cables 32 can be single mode or multi-mode fiber optic cables. The fiber optic cables 32 can be coupled to the tubing 22 by couplers 34. In some aspects, the couplers 34 are cross-coupling protectors located at every other joint of the tubing 22. The fiber optic cables 32 can be communicatively coupled to the fiber optic interrogator 30 that is at the surface 16.

The fiber optic interrogator 30 can output a light signal to the fiber optic cables 32. Part of the light signal can be reflected back to the fiber optic interrogator 30. The interrogator can perform interferometry and other analysis using the light signal and the reflected light signal to determine how the light is changed, which can reflect sensor changes that are measurements of the acoustics in the wellbore 12.

Figure 2:
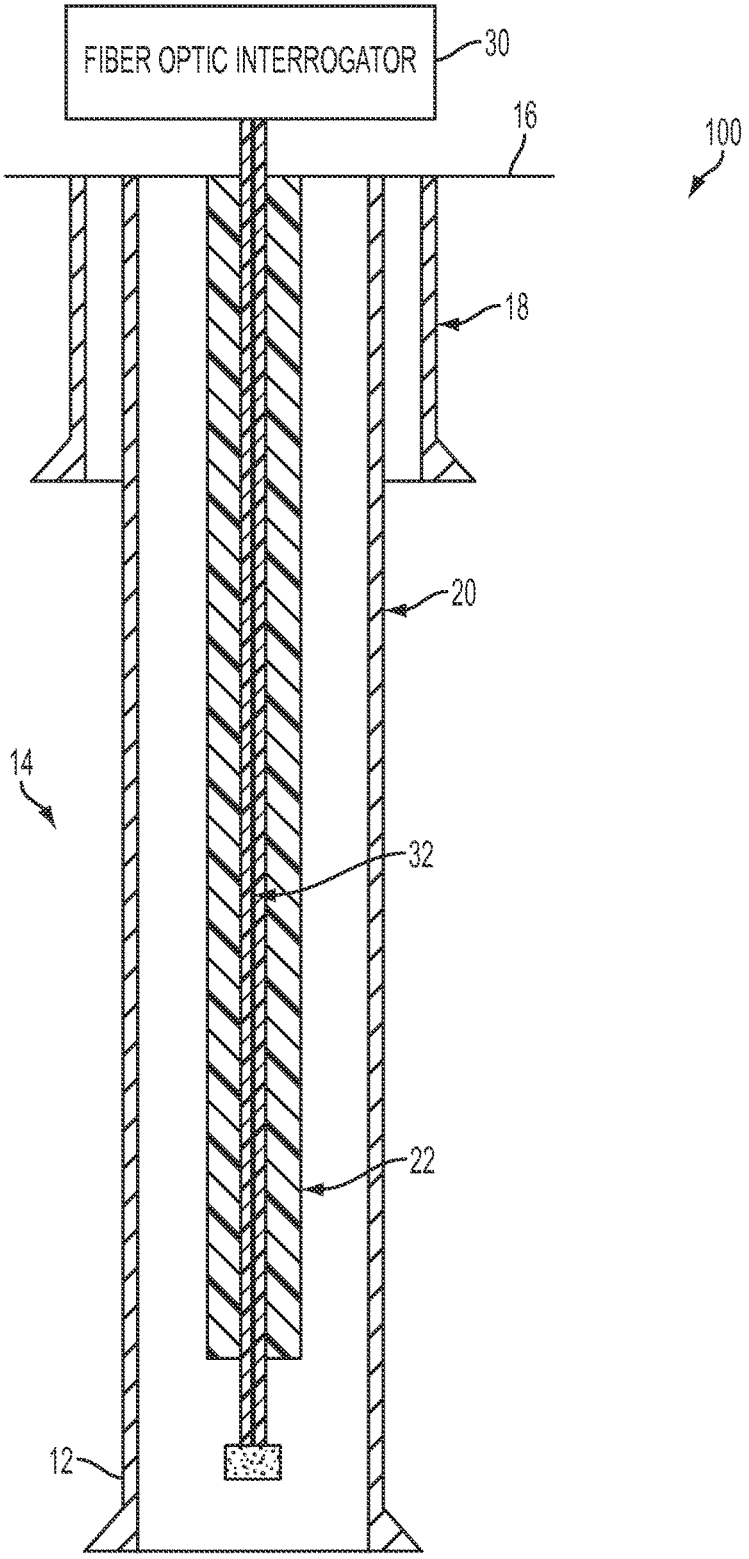
FIG. 2 is a cross-sectional schematic view of a wellbore that includes a fiber optic acoustic sensing subsystem according to another aspect.
Figure 13:
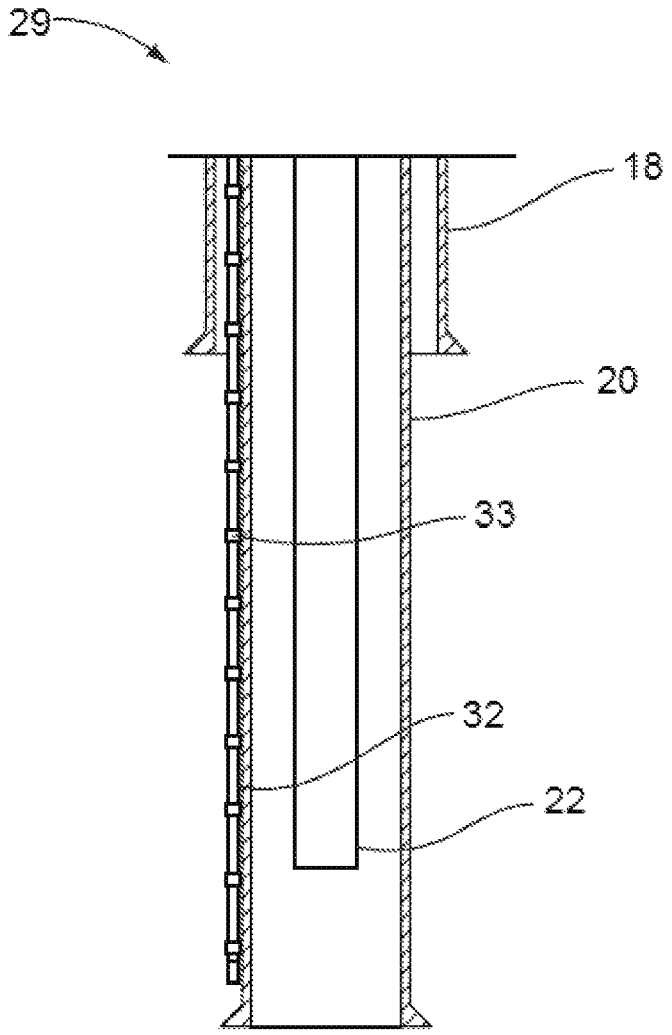
FIG. 13 is a cross-sectional schematic view of a wellbore that includes a fiber optic acoustic sensing subsystem according to another aspect.

Fiber optic cables according to various aspects can be located in other parts of a wellbore. For example, a fiber optic cable can be located on a retrievable wireline or external to a production casing. FIG. 2 depicts a wellbore system 100 that is similar to the wellbore system 10 in FIG. 1. It includes the wellbore 12 through the subterranean formation 14. Extending from the surface 16 of the wellbore 12 is the surface casing 18, the production casing 20, and tubing 22 in an inner area defined by the production casing 20. The wellbore system 100 includes a fiber optic acoustic sensing subsystem. The fiber optic acoustic sensing subsystem includes the fiber optic interrogator 30 and the fiber optic cables 32. The fiber optic cables 32 are on a retrievable wireline. FIG. 13 depicts an example of a wellbore system 29 that includes a surface casing 18, production casing 20, and tubing 22 extending from a surface. The fiber optic acoustic sensing subsystem includes a fiber optic interrogator (not shown) and the fiber optic cables 32. The fiber optic cables 32 are positioned external to the production casing 20. The fiber optic cables 32 can be coupled to the production casing 20 by couplers 33.

Figure 3:
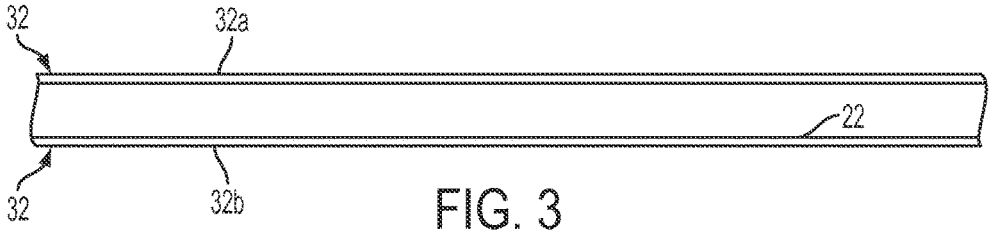
FIG. 3 is a cross-sectional side view of a two-fiber acoustic sensing system according to one aspect.

FIG. 3 is a cross-sectional side view of an example of the tubing 22 and the fiber optic cables 32. The fiber optic cables 32 are positioned external to the tubing 22. The fiber optic cables 32 can include any number of cables. The fiber optic cables 32 in FIG. 3 include two cables: fiber optic cable 32*a* and fiber optic cable 32*b*. The fiber optic cables 32 may perform distributed flow monitoring using Rayleigh backscatter distributed acoustic sensing.

Figure 4:
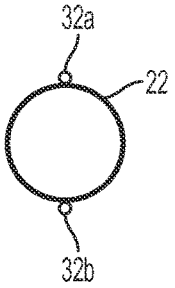
FIG. 4 is a cross-sectional view of tubing with fiber optic cables positioned at different angular positions external to the tubing according to one aspect.
Figure 5:
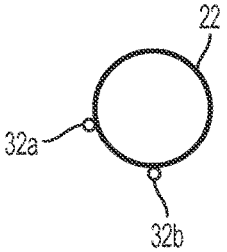
FIG. 5 is a cross-sectional view of tubing with fiber optic cables positioned at different angular positions external to the tubing according to another aspect.

Fiber optic cable 32*a* and fiber optic cable 32*b* can be positioned at different angular positions relative to each other and external to the tubing 22. FIGS. 4 and 5 depict a cross-sectional views of examples of the tubing 22 with fiber optic cables 32 positioned at different angular positions external to the tubing 22. In FIG. 4, fiber optic cable 32*a* is positioned directly opposite from fiber optic cable 32*b*. In FIG. 5, fiber optic cable 32*a* is positioned approximately eighty degrees relative to fiber optic cable 32*b*. Any amount of angular offset can be used. The angular positions of the fiber optic cables 32 may be used for common mode noise rejection. For example, a difference in acoustical signals from the fiber optic cables 32 at different angular locations on the tubing 22 can be determined. The difference may be filtered to remove high or low frequencies, such as a sixty hertz power frequency associated with the frequency of alternating current electricity used in the United States. A statistical measure of that difference signal, which is the variance, root mean square, or standard deviation, can be performed to determine the flow rate. For example, the flow rate can be characterized based on a density of fluid and the density of fluid can be known because the fluid introduced into the wellbore for stimulation can be controlled. Moreover, other aspects of the fluid related to the proportionality constant can be characterized through a calibration process since the fluid introduced into the wellbore for stimulation can be controlled.

FIGS. 6-12 depict additional examples of fiber optic cables and tubing 22.

Figure 6:
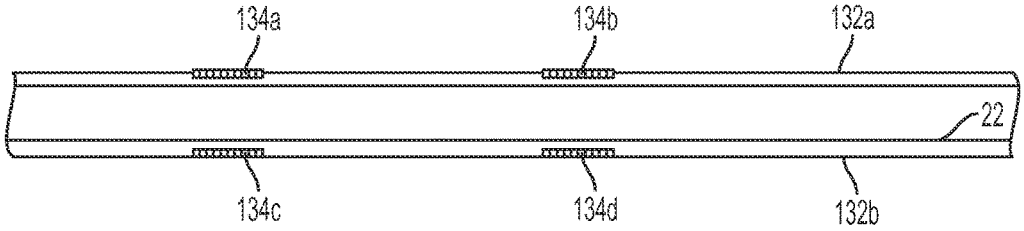
FIG. 6 is a cross-sectional side view of a two-fiber acoustic sensing system with fiber Bragg gratings according to one aspect.
Figure 7:
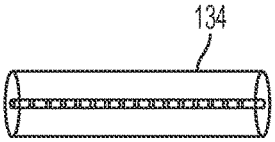
FIG. 7 is a schematic view of a fiber Bragg grating usable as a sensor according to one aspect.

FIG. 6 is a cross-sectional side view of the tubing 22 with fiber optic cables 132*a*-*b* positioned external to the tubing 22. The fiber optic cables 132*a-b* include fiber Bragg gratings 134*a-d*. Each of the fiber Bragg gratings 134*a-d* can be a sensor that can detect acoustics in the wellbore. The fiber optic cables 132*a-b* can each include any number of fiber Bragg gratings 134*a-d*. FIG. 7 is a cross-sectional side view of an example of a fiber Bragg grating 134. The fiber Bragg grating 134 includes a uniform structure. Other structures, such as a chirped fiber Bragg grating, a tilted fiber Bragg grating, and a superstructure fiber Bragg grating, can be used. The fiber Bragg grating 134 can reflect particular wavelengths of light and the wavelengths can change depending on the acoustical energy present in the wellbore.

Figure 8:
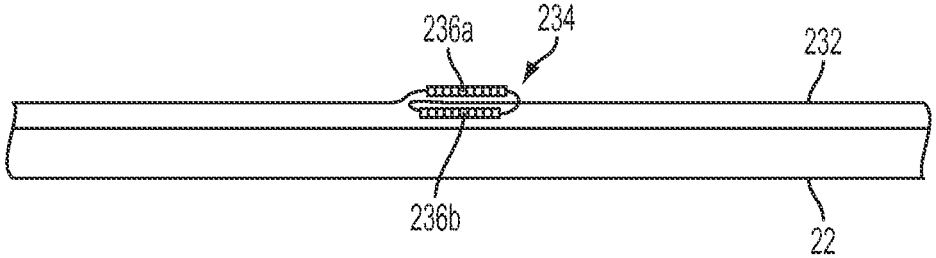
FIG. 8 is a cross-sectional side view of a single-fiber acoustic sensing system with fiber Bragg gratings according to one aspect.

FIG. 8 is a cross-sectional side view of the tubing 22 with a single fiber optic cable 232. The fiber optic cable 232 includes a coil 234 in which fiber Bragg gratings 236*a-b* are located. The coil 234 can simulate a two-fiber cable. The fiber Bragg gratings 236*a-b* can sense acoustical energy in the wellbore and a signal representing the acoustical energy can be received at the surface and analyzed to determine parameters of stimulation fluid. Although FIG. 8 depicts the fiber optic cable 232 including one coil 234, any number of coils can be used.

Figure 9:
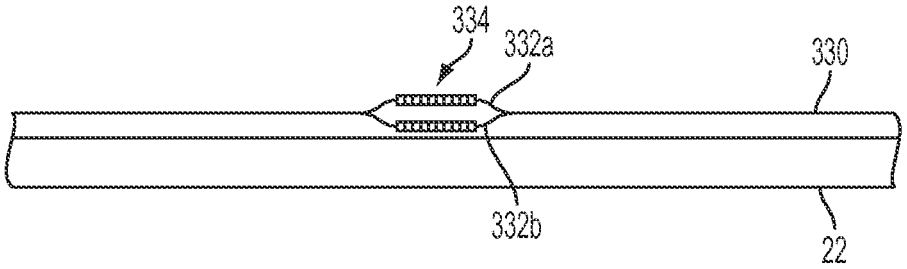
FIG. 9 is a cross-sectional side view of a cable housing containing multiple fiber optic cables that include fiber Bragg gratings according to one aspect.
Figure 10:
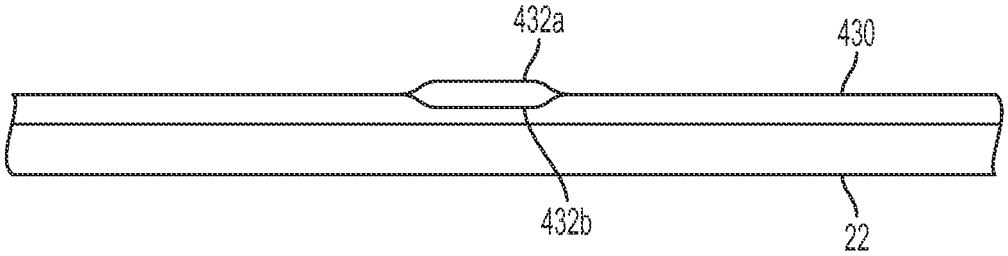
FIG. 10 is a cross-sectional side view of a cable housing containing multiple fiber optic cables that can be periodically exposed from the cable housing according to one aspect.

FIG. 9 is a cross-sectional side view of the tubing 22 with a cable housing 330. In the cable housing 330 are two fiber optic cables 332*a-b*. The two fiber optic cables 332*a-b* can be periodically exposed and separated in the wellbore for measuring acoustical energy in the wellbore. FIG. 9 depicts one instance of the fiber optic cables 332*a-b* exposed from the cable housing 330 and separated, but any number of instances can be used. The fiber optic cables 332*a-b* include fiber Bragg gratings 334 also exposed from the cable housing 330, but other implementations may not include the fiber Bragg gratings 334. For example, FIG. 10 is a cross-sectional side view of the tubing 22 with a cable housing 430 that includes two fiber optic cables 432*a-b* exposed and separated in the wellbore for measuring acoustical energy.

Figure 11:
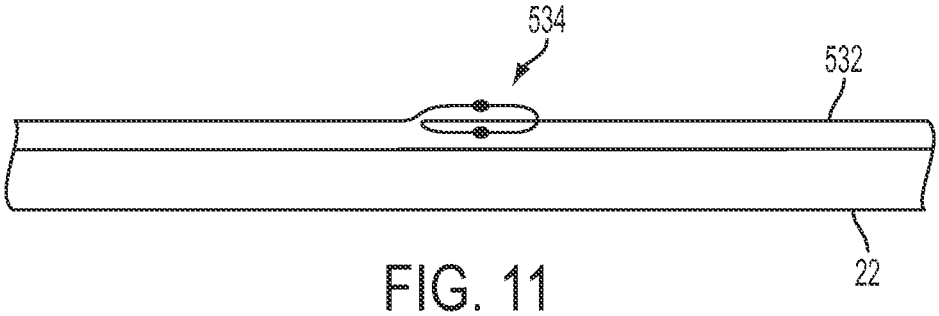
FIG. 11 is a cross-sectional side view of a fiber optic cable that includes a coiled and spooled portion as a sensor according to one aspect.

FIG. 11 is a cross-sectional side view of the tubing 22 with a fiber optic cable 532 that is coiled and spooled periodically in the wellbore. FIG. 11 depicts one instance 534 of the fiber optic cable 532 coiled and spooled. Coiling and spoiling the fiber optic cable 532 can increase gain for sensing acoustical energy in the wellbore.

Figure 12:
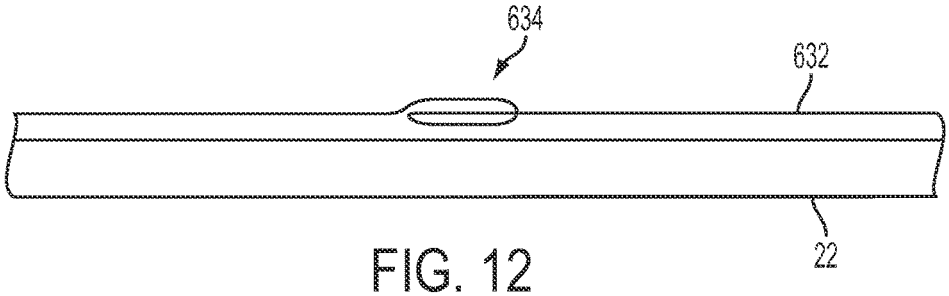
FIG. 12 is a cross-sectional view of a fiber optic cable that includes a coil as a sensor according to one aspect.

FIG. 12 is a cross-sectional view of the tubing 22 with a fiber optic cable 632 that includes a coil 634. The coil 634 in the fiber optic cable 632 can sense acoustical energy in the wellbore.

Distributed sensing of flow at one or more downhole locations as in the figures or otherwise can be useful in monitoring flow downhole during stimulation operations. In some aspects, a fiber optic cable includes a sensor that is a stimulation fluid flow acoustic sensor. The sensor is responsive to acoustic energy in stimulation fluid in a wellbore by modifying light signals in accordance with the acoustic energy. The sensor may be multiple sensors distributed in different zones of a wellbore. The sensor may be the fiber optic cable itself, fiber Bragg gratings, coiled portions of the fiber optic cable, spooled portions of the fiber optic cable, or a combination of these. A fiber optic interrogator may be a stimulation flow rate fiber optic interrogator that is responsive to light signals modified in accordance with the acoustic energy and received from the fiber optic cable by determining flow rate of the stimulation fluid.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system, comprising:

fiber optic cables that include stimulation fluid flow acoustic sensors for acoustically measuring data representing a flow of a stimulation fluid, the fiber optic cables including a first fiber optic cable and a second fiber optic cable arranged along a tubing positionable in a well for rejecting common mode noise in the data; and a stimulation flow rate fiber optic interrogator that is configured to:

receive a first signal from the first fiber optic cable and a second signal from the second fiber optic cable; and in response to receiving the first signal and the second signal, (i) determine a difference signal by subtracting the first signal from the second signal for rejecting common mode noise; (ii) determine a filtered difference signal by filtering the difference signal to remove frequencies external to a predetermined band of frequencies; and (iii) perform a statistical measure of the filtered difference signal to determine a flow rate of the stimulation fluid in the well.

2. The system of claim 1, wherein the first signal and the second signal received from the fiber optic cables represent acoustically sensed information of the stimulation fluid.

3. The system of claim 1, wherein the fiber optic cables are coupled to the tubing and the stimulation fluid is fracturing fluid usable in a subterranean formation fracturing operation.

4. The system of claim 3, wherein the tubing is retrievable wireline.

5. The system of claim 3, wherein the first fiber optic cable is positioned in the well by a wireline deployment and the second fiber optic cable is positioned in the well by a non-wireline deployment.

6. The system of claim 1, wherein the fiber optic cables are in a cable housing external to the tubing, and the stimulation fluid flow acoustic sensors are periodically exposed from the cable housing in the well.

7. The system of claim 1, wherein the stimulation fluid flow acoustic sensors are spaced periodically along the fiber optic cables and respond to acoustic energy in the well by acoustically sensing flow of stimulation fluid separately in different zones of the well.

8. The system of claim 7, wherein the stimulation fluid flow acoustic sensors include a fiber Bragg grating.

9. The system of claim 6, wherein the stimulation fluid flow acoustic sensors include a coiled portion of a fiber optic cable that includes a spooled sub-portion of the fiber optic cable.

10. The system of claim 1, wherein the fiber optic cables are positioned external to a casing.

11. A system, comprising:

a stimulation flow rate fiber optic interrogator that is configured to:

receive a first signal from a first fiber optic cable and a second signal from a second fiber optic cable, the first fiber optic cable and the second fiber optic being fiber optic cables that are arrangeable along a tubing positionable in a wellbore; and in response to receiving the first signal and the second signal, (i) determine a difference signal by subtracting the first signal from the second signal for rejecting common mode noise; (ii) determine a filtered difference signal by filtering the difference signal to remove frequencies external to a predetermined band of frequencies; and (iii) perform a statistical measure of the filtered difference signal to determine a flow rate of a stimulation fluid in the wellbore.

12. The system of claim 11, further comprising the fiber optic cables, wherein the fiber optic cables have distributed stimulation fluid flow acoustic sensors, and wherein the fiber optic cables are arranged along the tubing for rejecting the common mode noise and responding to acoustic energy from the stimulation fluid to produce the first and second signals.

13. The system of claim 12, wherein the distributed stimulation fluid flow acoustic sensors include a fiber Bragg grating.

14. The system of claim 12, wherein the distributed stimulation fluid flow acoustic sensors include coiled and spooled portions.

15. The system of claim 12, wherein the distributed stimulation fluid flow acoustic sensors are positionable in separate zones in the wellbore.

16. A method, comprising:

receiving, by a fiber optic interrogator, a first signal from a first fiber optic cable positioned in a wellbore and a second signal from a second fiber optic cable positioned in the wellbore, the first signal and second signal being associated with a flow of a stimulation fluid in the wellbore;

determining, by the fiber optic interrogator, a difference signal by subtracting the first signal from the second signal to reject common mode noise among the first signal and the second signal;

determining, by the fiber optic interrogator, a flow rate of the stimulation fluid in the wellbore by performing a statistical measure of the difference signal.

17. The system of claim 12, wherein the fiber optic cables are arranged along the tubing at different angular positions from one another.

18. The system of claim 1, wherein the fiber optic cables are arranged along the tubing at different angular positions from one another.

19. The method of claim 16, wherein the first signal and the second signal are generated as a result of acoustic waves transmitted by the stimulation fluid impacting the first fiber optic cable and the second fiber optic cable, respectively.

20. The method of claim 16, further comprising determining a filtered difference signal by filtering the difference signal to remove frequencies external to a predetermined band of frequencies.

* * * * *